US006253414B1

(12) United States Patent
Bradd et al.

(10) Patent No.: US 6,253,414 B1
(45) Date of Patent: Jul. 3, 2001

(54) CARPET EXTRACTOR WITH HEADLIGHTS

(75) Inventors: Sidney H. Bradd, Solon; John D. Essex, North Canton, both of OH (US)

(73) Assignee: The Hoover Company, North Canton, OH (US)

( * ) Notice: Subject to any disclaimer, the term of this patent is extended or adjusted under 35 U.S.C. 154(b) by 0 days.

(21) Appl. No.: 09/552,327

(22) Filed: Apr. 19, 2000

Related U.S. Application Data

(60) Provisional application No. 60/137,566, filed on Jun. 4, 1999.

(51) Int. Cl.[7] ..... A47L 9/30
(52) U.S. Cl. ..... 15/320; 15/324
(58) Field of Search ..... 15/320, 324

(56) References Cited

U.S. PATENT DOCUMENTS

| | | | | |
|---|---|---|---|---|
| D. 405,571 | | 2/1999 | Gildersleeve . | |
| 1,628,770 | | 5/1927 | Finnell . | |
| 1,996,934 | * | 4/1935 | Siedle | 15/324 X |
| 2,064,388 | | 12/1936 | Smellie . | |
| 2,088,482 | | 7/1937 | Packer . | |
| 2,190,678 | | 2/1940 | Replogle . | |
| 2,274,971 | | 3/1942 | White . | |
| 2,475,400 | | 7/1949 | Osborn . | |
| 2,682,604 | | 6/1954 | Gerber . | |
| 2,734,214 | * | 2/1956 | Gerber | 15/324 |
| 2,769,997 | * | 11/1956 | Sheahan | 15/324 |
| 3,049,744 | | 8/1962 | MacFarland . | |
| 3,328,820 | | 7/1967 | Doersam . | |
| 3,848,291 | | 11/1974 | Morse . | |
| 4,656,687 | * | 4/1987 | Wei | 15/324 |
| 4,791,700 | | 12/1988 | Bigley et al. . | |
| 5,467,501 | | 11/1995 | Sepke . | |
| 5,937,475 | * | 8/1999 | Kasen et al. | 15/320 |
| 5,983,443 | * | 11/1999 | Redding | 15/324 |

FOREIGN PATENT DOCUMENTS

| | | |
|---|---|---|
| 772108 | 4/1934 | (FR) . |
| 345006 | 3/1931 | (GB) . |
| 600236 | 4/1948 | (GB) . |

OTHER PUBLICATIONS

Hoover®, Brush–Vac™ Compact Stick Vacuum Cleaner, Model S2211 Specification Sheet, Copyright 1996.

Hoover®, Self–Propelled Wind Tunnel™ Ultra Upright Vacuum Cleaner, Model U6425–900 Specification Sheet, Copyright 1998.

Royal, Dirt Devil, Easy Steamer, copy of owner's manual, pp. 1,4,5,8,9,10, Introduced Aug. 1999.

* cited by examiner

*Primary Examiner*—Chris K. Moore
(74) *Attorney, Agent, or Firm*—A. Burgess Lowe; Bruce P. Watson

(57) ABSTRACT

A carpet extractor is disclosed having scrub brushes located behind a transparent suction nozzle, whereby the brushes are visible through the nozzle. A main frame of the extractor is formed with transparent portions adjacent to the ends of the brushes, so that he brushes are also visible from the sides of the extractor. Headlights are provided on either side of the suction nozzle for illuminating the floor adjacent to the suction nozzle. The headlights are formed so that a portion of the light emitted by the headlights passes through a transparent portion of the main frame adjacent to the brushes and illuminates the brushes for improved viewing of he brushes. The headlights are also formed so that a portion of the light emitted by the headlights passes through the edge walls of the suction nozzle and illuminates the soiled cleaning liquid traveling through the nozzle.

25 Claims, 5 Drawing Sheets

CARPET EXTRACTOR WITH HEADLIGHTS

This application claims the benefit of Prov. No. 60/137,566 filed Jun. 4, 1999.

BACKGROUND OF THE INVENTION

1. Technical Field

The present invention pertains to a carpet cleaning machine, commonly referred to as a carpet extractor, having headlights for illuminating the floor in front of the machine. More particularly, this application pertains to a carpet extractor having headlights, a transparent suction nozzle for observation of soiled liquid being picked up by the machine and rotating scrub brushes located behind the transparent nozzle for observation of the brushes through the transparent nozzle. Even more specifically, the present invention pertains to such a carpet extractor that has a main frame having transparent portions and in which a portion of the light emitted by the headlights is transmitted through the transparent portions of the main frame into the nozzle for illuminating liquid in the nozzle and into the brush cavity for illuminating the brushes.

2. Background Information

Carpet extractors clean carpets by distributing a cleaning liquid onto a carpet and then extracting the soiled cleaning liquid from the carpet using a suction nozzle. The soiled cleaning liquid is separated from the working air and recovered in a tank for disposal. Carpet extractors frequently employ rotating scrub brushes for distributing the cleaning liquid on the carpet, scrubbing the cleaning liquid into the carpet and loosening embedded soil for extraction with the cleaning liquid using a suction nozzle. It is desirable to enhance the visibility of the soiled cleaning liquid traveling through the nozzle and of the scrub brushes, so that the machines cleaning ability will be readily apparent to a consumer or an operator.

The suction nozzles on carpet extractors typically have a transparent outer wall and are typically located in view of the operator, whereby the operator may view the soiled cleaning liquid being sucked in through the nozzle while operating the cleaner. Such a carpet extractor is disclosed in commonly owned U.S. Pat. No. 5,500,977. It is also known in the prior art to provide a headlight on a carpet extractor nozzle for illuminating the floor in front of the nozzle, such as disclosed in U.S. Pat. No. 3,848,291. It is also known to provide an upright, dry only vacuum cleaner with a transparent window in the suction nozzle that provides visual observation of the agitator located inside the suction nozzle cavity.

SUMMARY OF THE INVENTION

An objective of the present invention is to provide a carpet extractor having enhanced visibility of the rotating scrub brush(es). More particularly, it is an object of the present invention to provide visibility of a powered scrub brush located behind the suction nozzle from the front of the machine, i.e. through the suction nozzle, and from the sides of the machine.

A further objective of the present invention is to provide a carpet extractor with improved visibility of the soiled cleaning solution traveling through the suction nozzle.

Yet another objective of the present invention is to provide a carpet extractor with at least one headlight for illuminating the floor in front of the machine, adjacent to the suction nozzle. More specifically, an objective of the invention is to provide an extractor with at least one headlight, in which a portion of the light emitted by the headlight shines onto the scrub brush, thereby enhancing visibility of the scrub brush. A further object of the invention is to utilize a portion of the light emitted by the headlight to illuminate the soiled cleaning liquid traveling through the suction nozzle.

These and other objectives, that will be readily apparent to one of skill in the art upon reading the following description and reviewing the accompanying drawings, are obtained by the present invention.

BRIEF DESCRIPTION OF DRAWINGS

An embodiment of the present invention will now be described, by way of example, with reference to the accompanying drawings, of which.

Similar numerals refer to similar parts throughout the drawings.

DESCRIPTION OF A PREFERRED EMBODIMENT

Figure 1:
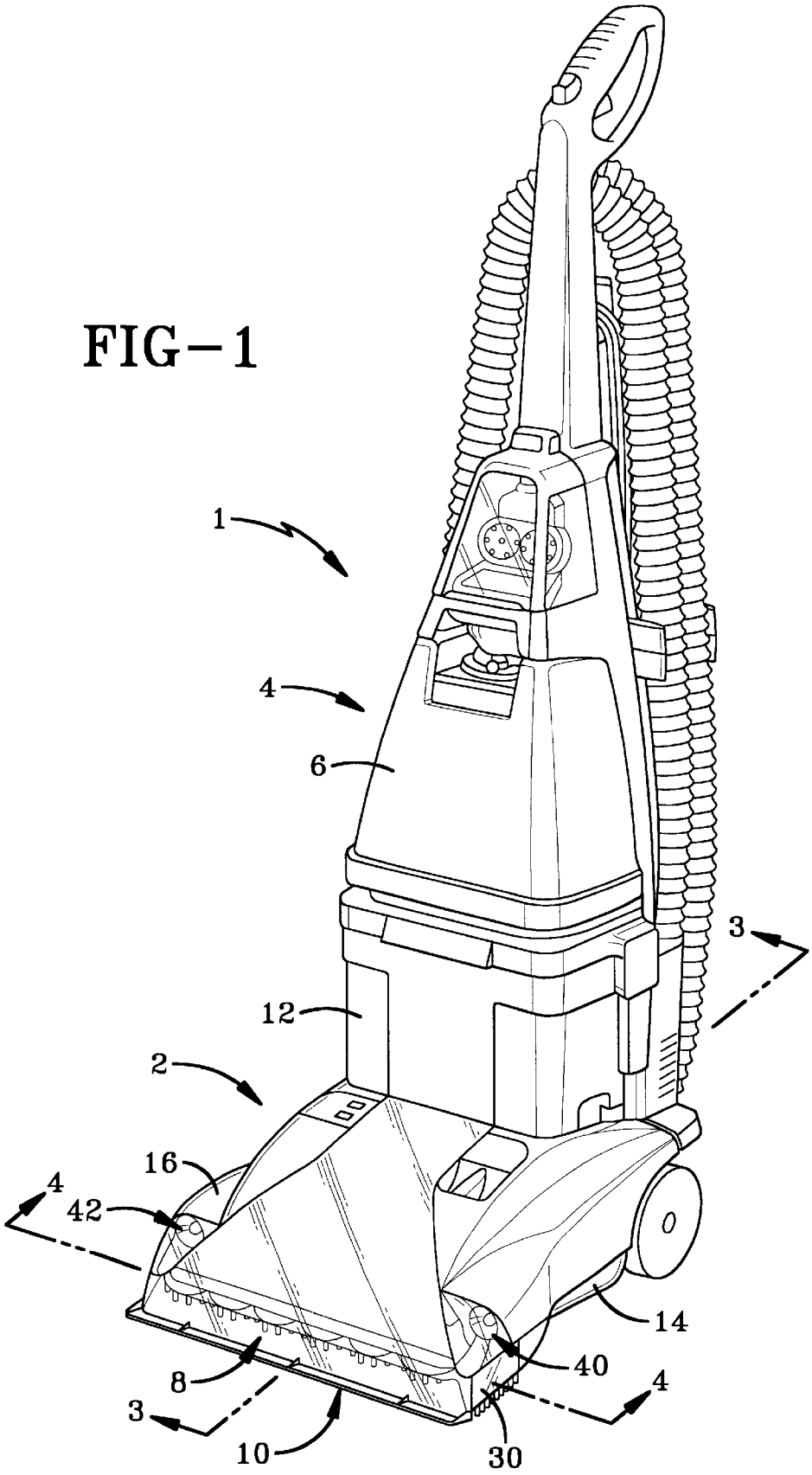
FIG. 1 is a pictorial representation of a carpet extractor according to the present invention.

A carpet extractor 1 according to one form or preferred embodiment of the present invention is diagrammatically illustrated in FIG. 1. The preferred carpet extractor is an upright style carpet extractor 1 having a foot or lower floor engaging portion 2 with a handle portion 4 pivotally attached to the foot for propelling the cleaner over a floor. The foot includes a cleaning solution distributor (not shown). The distributor receives cleaning solution from a supply tank 6 mounted on the handle portion and distributes the cleaning solution to a plurality of vertical axis scrub brushes 8. The scrub brushes then spread the cleaning liquid onto the carpet, scrub the cleaning liquid into the carpet and dislodge embedded soil from the carpet. The soiled cleaning liquid is then extracted from the carpet by a suction nozzle 10 attached to the foot. The soiled cleaning liquid is separated form the working air and collected in a recovery tank 12 that is removably mounted on the foot 2. A suitable upright carpet extractor is disclosed in co-owned U.S. Pat. No. 5,500,977, the disclosure of which is hereby incorporated herein as of reference. The preferred scrub brushes and cleaning liquid distributor are disclosed in commonly owned U.S. Pat. No. 6,009,593 and in U.S. Pat. No. 5,867,857, respectively, the disclosures of both of which are hereby incorporated herein as of reference.

Figure 2:
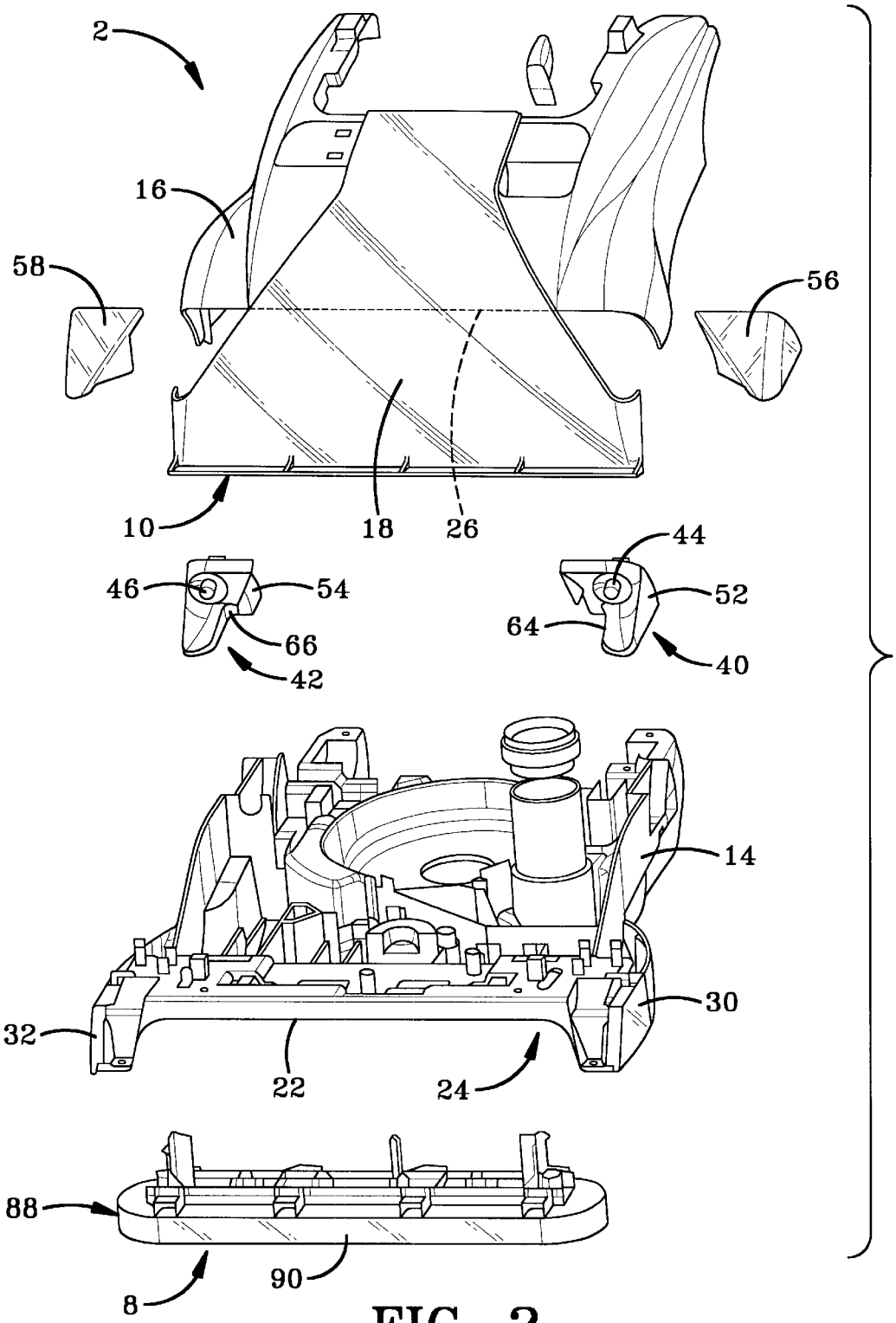
FIG. 2 is a partially exploded view of the lower floor engaging portion of the carpet extractor of FIG. 1.
Figure 3:
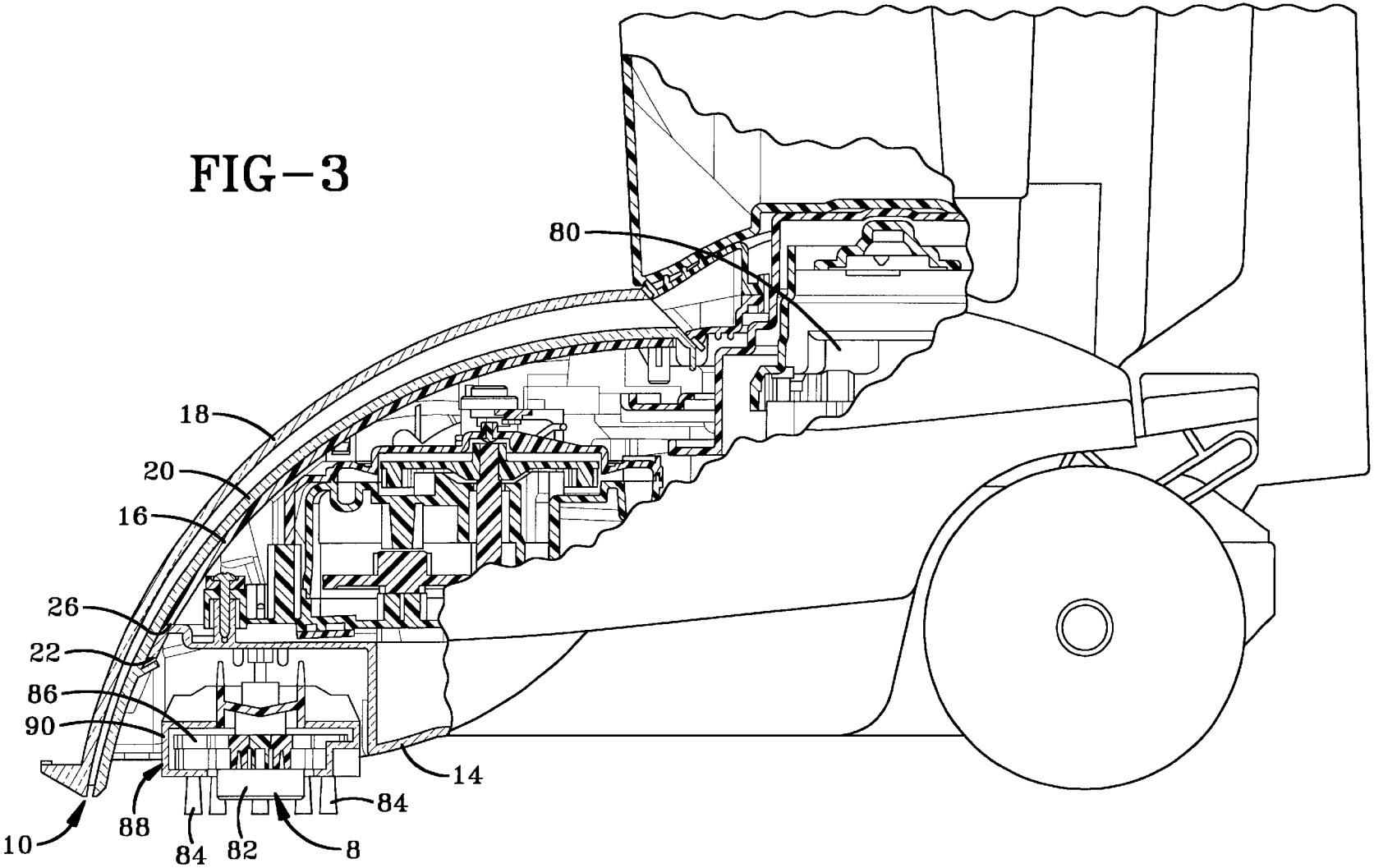
FIG. 3 is a cross section of the floor engaging portion taken substantially along line 3—3 in FIG. 1.
Figure 4:
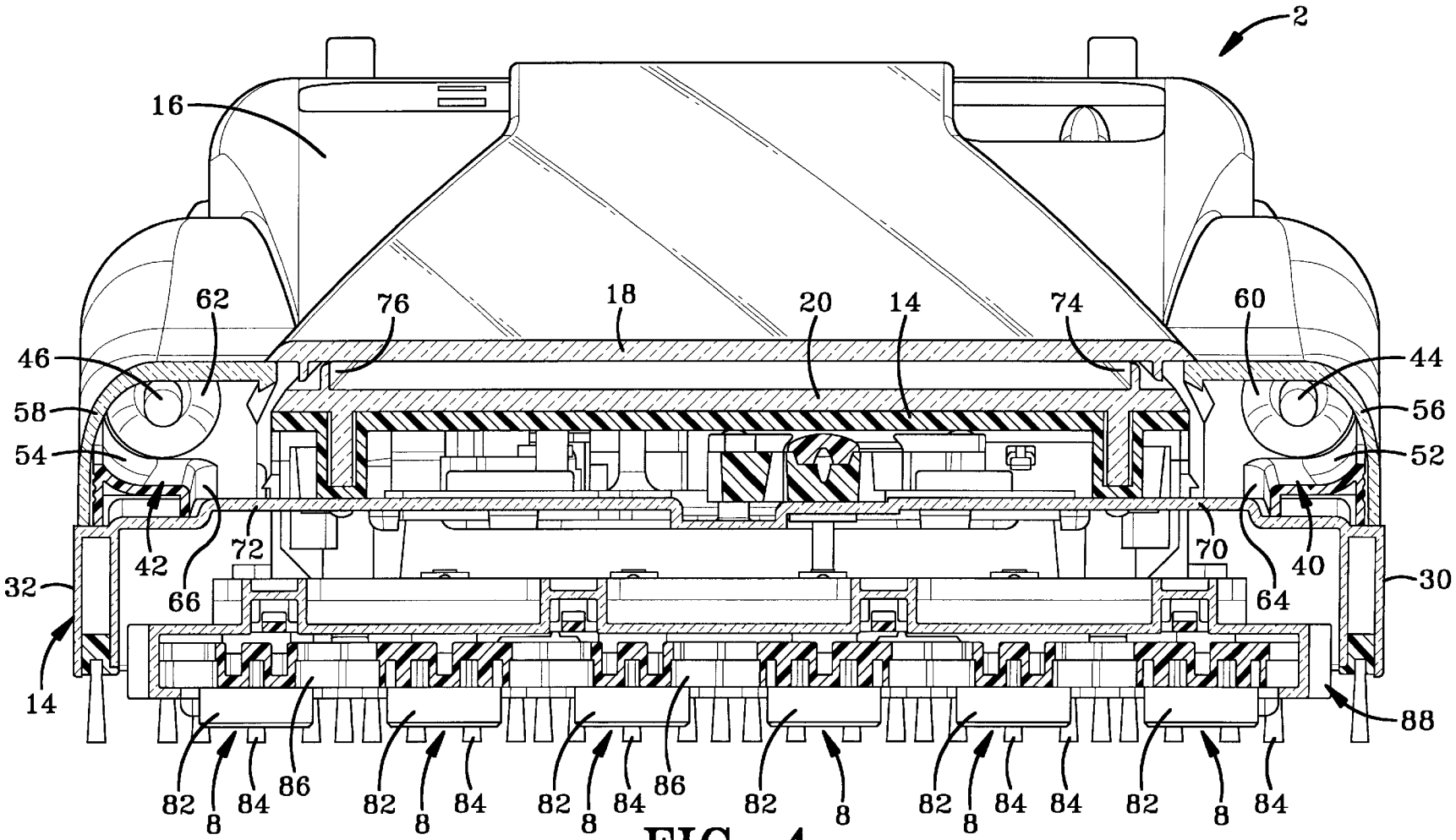
FIG. 4 is a cross section of the floor engaging portion taken substantially along line 4—4 in FIG. 1.

Referring now to FIG. 2 the foot is formed of a main frame 14 and a hood 16 that are fastened together in any suitable fashion. The suction nozzle 10 is formed of a transparent nozzle front plate 18 and a transparent nozzle rear plate 20 (as shown on FIGS. 3 and 4) and is received in a recess in the top of the hood. A lower front edge 22 of a front wall of the main frame 14 has a recess 24 formed therein. A front lower edge 26 of the hood 16 mates with the top of the front wall of the main frame. With this construction, the brushes 8, which are mounted to the main frame behind the suction nozzle, are visible through the transparent nozzle plates and through the recess 24 in the main frame. The brushes are thus visible from the front of the machine. The scrub brushes are also visible from either side of the extractor through transparent portions 30, 32 of the main frame 14 located adjacent to the suction nozzle and next to the scrub brushes.

Headlights 40 and 42 are located on the front of the foot on either side of the suction nozzle 10 for illuminating the floor in front of the nozzle. The headlights include electric lamps 44, 46 mounted in sockets that are in turn mounted in light housings 52, 54. The light housings are captured between the hood 16 and the main frame 14. The headlight assemblies are completed by transparent lenses 56, 58 that are secured to the main frame 14 by screws or other suitable means (not shown). The forward surfaces of the light housings are coated with a reflective material and are formed with concave Schnelling 60, 62 surrounding the lamps that focus the light emitted by the lamps on the floor generally in front of the suction nozzle.

Cutouts or recesses 64, 66 are formed on the inner sides of the light housings 52, 54 closest to the scrub brushes 8. Portions 70, 72 of the main frame 14 located between the cutouts 64, 66 in the light housings and the scrub brushes 8 are formed of transparent material. The lamps 44, 46 are located in the housings such that at least a portion of the light emitted by the lamps passes directly from the lamps, through the cutouts, through the transparent portions of the main frame and illuminates the scrub brushes.

A portion of the light emitted by the lamps also passes through, the cutouts 64, 66, through sidewalls 74, 76 of the nozzle 10 (formed by at least one of the nozzle top plate 18 and the nozzle bottom plate 20), and into the interior of the suction nozzle. Soiled cleaning liquid traveling through the suction nozzle is thus illuminated by the headlights, providing improved visibility of the soiled liquid traveling through the nozzle.

Figure 5:
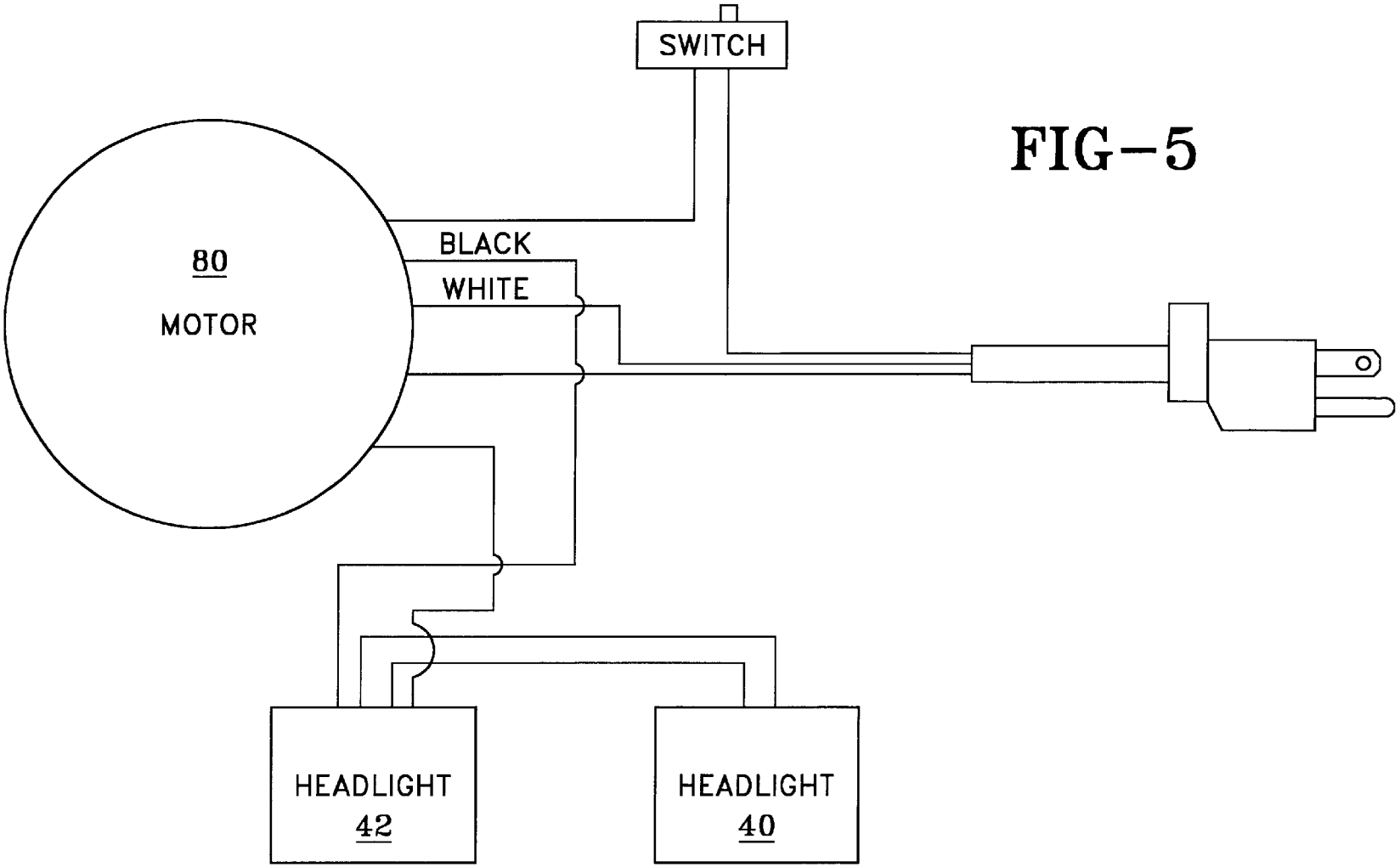
FIG. 5 is an electrical schematic a carpet extractor with headlights according to the present invention.

As illustrated in FIG. 5, the headlights 40, 42 are powered by tapping the field of an electric motor 80 that is preferably mounted to the main frame 14 (not shown in FIG. 5). The motor is part of a conventional motor fan assembly that creates the working air flow by creating a partial vacuum in the recovery tank in a known manner.

The preferred scrub brushes 8 each include a plastic hub 82 having a plurality of groups of bristles 84 extending down therefrom for scrubbing the floor. Gear teeth 86 are formed in the outer peripheral surface of the gear hubs. The gear teeth on each scrub brush 8 are captured in a brush block 88. A forward wall 90 of the brush block is formed of transparent material and is planar, for enhancing visibility of the scrub brushes 8 therethrough. The scrub brush hubs and bristles are preferably formed of a brightly colored materials, for example, fluorescent green, to provide improved visibility of the brushes through the nozzle.

The transparent portions of the main frame are preferably provided by forming the entire main frame 14 out of transparent material, preferably a transparent thermoplastic material, such as an acrylic or polycarbonate. The outer surface of the remaining portions of the main frame are preferably textured, making these portions of the main frame more opaque, so that substantially only the brushes are clearly visible through the main frame.

The present invention has been described by way of example using a preferred embodiment. Modifications to and variations of the preferred embodiment will be readily apparent to one of skill in the art upon reading the above description and reviewing the appended drawings. For example, rather than providing a plurality of vertical axis scrub brushes, a single horizontal axis brush roll or other suitable scrubbing element may be employed to scrub the cleaning liquid into the carpet. Likewise, it will be appreciated that a single headlight or more than two headlights my be employed without departing from the spirit and scope of the present invention.

In view of the above, it is intended that the present invention not be limited by the preceding detailed description of one form or preferred embodiment of the present invention, but rather include all modifications and variations of the disclosed embodiment within the spirit and scope of the present invention.

What is claimed is:

1. A carpet extractor having a floor engaging portion and a handle extending from said floor engaging portion for propelling said floor engaging portion along a floor, a cleaning liquid supply tank providing a source of cleaning liquid, a recovery tank, and a motor fan assembly, said floor engaging portion having a front portion and including a cleaning solution applicator in fluid communication with said supply tank for receiving cleaning liquid from said supply tank and distributing the cleaning liquid upon a floor surface and a suction nozzle in fluid communication with said motor fan assembly and said recovery tank for extracting soiled cleaning liquid from the floor surface and depositing said recovered liquid in said recovery tank, said suction nozzle having a front edge, and a side edge, wherein the improvement comprises:

a headlight on said front portion of said floor engaging portion adjacent to said side edge of said suction nozzle for illuminating a portion of said floor adjacent to said suction nozzle.

2. A carpet extractor according to claim 1, wherein said handle is pivotally attached to said floor engaging portion.

3. A carpet extractor according to claim 2, wherein said recovery tank is removably mounted to said floor engaging portion.

4. A carpet extractor according to claim 3, comprising two said headlights located one on each side of said suction nozzle.

5. A carpet extractor according to claim 3, wherein said supply tank is removably mounted to said handle.

6. A carpet extractor having a floor engaging portion and a handle extending from said floor engaging portion for propelling said floor engaging portion along a floor, a cleaning liquid supply tank providing a source of cleaning liquid, a recovery tank, and a motor fan assembly, said floor engaging portion including a cleaning solution applicator in fluid communication with said supply tank for receiving cleaning liquid from said supply tank and distributing the cleaning liquid upon a floor surface and a suction nozzle in fluid communication with said motor fan assembly and said recovery tank for extracting soiled cleaning liquid from the floor surface and depositing said recovered liquid in said recovery tank, wherein the improvement comprises:

a headlight on said floor engaging portion for illuminating a portion of said floor adjacent to said suction nozzle;

wherein said suction nozzle is at least partially formed with a substantially transparent nozzle front plate and said headlight is located such that a portion of the light emitted by said headlight passes through said suction nozzle front plate and illuminates the soiled cleaning liquid traveling through said suction nozzle.

7. A carpet extractor according to claim 6, comprising two said headlights located one on each side of said suction nozzle.

8. A carpet extractor according to claim 6, wherein said headlight comprises an electric lamp mounted in a concave light housing mounted to said floor engaging portion adjacent to said suction nozzle; and wherein a cutout is formed in said light housing proximate said suction nozzle, whereby a portion of the light emitted by said lamp passes through said cutout for illuminating soiled cleaning liquid traveling through said suction nozzle.

9. A carpet extractor according to claim 8, comprising two said headlights located one on each side of said suction nozzle.

10. A carpet extractor according to claim 1, further comprising a rotary brush mounted to said floor engaging portion for scrubbing the floor surface.

11. A carpet extractor having a floor engaging portion and a handle extending from said floor engaging portion for propelling said floor engaging portion along a floor, a cleaning liquid supply tank providing a source of cleaning liquid, a recovery tank, and a motor fan assembly, said floor engaging portion including a cleaning solution applicator in fluid communication with said supply tank for receiving cleaning liquid from said supply tank and distributing the cleaning liquid upon a floor surface and a suction nozzle in fluid communication with said motor fan assembly and said recovery tank for extracting soiled cleaning liquid from the floor surface and depositing said recovered liquid in said recovery tank, wherein the improvement comprises:

a headlight on said floor engaging portion for illuminating a portion of said floor adjacent to said suction nozzle;

a rotary brush mounted to said floor engaging portion for scrubbing the floor surface;

wherein at least a forward portion of said suction nozzle is formed of a substantially transparent nozzle front plate and a substantially transparent nozzle back plate; and said rotary brush is mounted to an underside of said floor engaging portion behind said suction nozzle, whereby said brush is visible through said nozzle front and nozzle back plates.

12. A carpet extractor according to claim 11, wherein said headlight is located such that a portion of the light emitted by said headlight illuminates at least a portion of said rotary brush.

13. A carpet extractor according to claim 12, wherein said headlight comprises an electric lamp mounted in a concave light housing mounted to said floor engaging portion; and wherein a cutout is formed in said light housing proximate said rotary brush, whereby a portion of the light emitted by said lamp passes through said cutout for illuminating at least a portion of said rotary brush.

14. A carpet deep cleaning machine comprising:

a floor engaging portion having a wet pickup suction nozzle mounted thereto for extracting soiled cleaning solution and other debris from a carpet, said suction nozzle having a transparent front wall joined to a rear wall by edge walls, said front, rear and edge walls enclosing a working airflow path; and an electric lamp mounted to said floor engaging portion, said lamp being located such that at least a portion of soiled cleaning solution and other debris traveling through said working airflow path is illuminated by said lamp.

15. A machine according to claim 14, wherein said lamp is mounted adjacent to one of said edge walls and said one edge wall is translucent, such that a portion of the light emitted by said lamp passes through said one edge wall.

16. A machine according to claim 15, comprising two said lamps located one on each side of said suction nozzle.

17. A machine according to claim 16, wherein said lamps are headlights located such that a portion of the light emitted by said lamps illuminates a portion of the carpet in front of said floor engaging portion.

18. A carpet extractor having a floor engaging portion, said floor engaging portion having a cleaning liquid applicator for applying cleaning liquid to a surface to be cleaned, at least one rotary scrub brush for scrubbing said applied cleaning liquid into a surface being cleaned, and a floor engaging suction nozzle for extracting soiled cleaning liquid from a surface being cleaned, wherein the improvement comprises:

said suction nozzle comprising a transparent front wall, a transparent rear wall spaced from and parallel to said front wall, and edge walls joining said front wall to said rear wall thereby enclosing an airflow passage within said front, rear and edge walls, said at least one scrub brush being located behind said suction nozzle in a location that provides visual observation of said scrub brush through said transparent front and rear walls of said suction nozzle; and, a lamp mounted to said floor engaging portion such that a portion of light emitted by said lamp illuminates at least a portion of said scrub brush.

19. An extractor according to claim 18, wherein at least a portion of said floor engaging portion located between said lamp and said scrub brush is formed of transparent material and said portion of light passes through said transparent portion of said floor engaging portion.

20. An extractor according to claim 19, wherein said lamp is a headlight located to illuminate a portion of the surface being cleaned in front of said suction nozzle.

21. An extractor according to claim 20, comprising two said headlights located one on each side of said suction nozzle.

22. A carpet extractor having a floor engaging portion and a handle extending from said floor engaging portion for propelling said floor engaging portion along a floor, a cleaning liquid supply tank providing a source of cleaning liquid, a recovery tank, and a motor fan assembly, said floor engaging portion including a cleaning solution applicator in fluid communication with said supply tank for receiving cleaning liquid from said supply tank and distributing the cleaning liquid upon a floor surface and a suction nozzle in fluid communication with said motor fan assembly and said recovery tank for extracting soiled cleaning liquid from the floor surface and depositing said recovered liquid in said recovery tank, said suction nozzle having a translucent front section and a side edge, wherein the improvement comprises:

a headlight on said floor engaging portion adjacent to said side edge of said suction nozzle for illuminating a portion of said floor adjacent to said suction nozzle.

23. A carpet extractor according to claim 22 wherein said suction nozzle has a second side edge opposite from said first mentioned side edge; and a second headlight located adjacent said second side edge.

24. A carpet extractor according to claim 22 wherein said floor engaging portion has a front portion, said headlight being located on said front portion.

25. A carpet extractor according to claim 22 wherein said floor engaging portion comprises a hood portion and a frame portion connected to said hood portion, said headlight being seated between said hood portion and said frame portion.

* * * * *